US012686965B2

(12) United States Patent
Boado Encinosa et al.

(10) Patent No.: US 12,686,965 B2
(45) Date of Patent: Jul. 21, 2026

(54) LAUNDRY APPLIANCE AIR FILTER WITH LABYRINTH SEAL

(71) Applicant: Haier US Appliance Solutions, Inc., Wilmington, DE (US)

(72) Inventors: Marla Boado Encinosa, Borden, IN (US); Alexander B. Leibman, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 85 days.

(21) Appl. No.: 18/652,347

(22) Filed: May 1, 2024

(65) Prior Publication Data

US 2025/0341039 A1 Nov. 6, 2025

(51) Int. Cl.

| | |
|---|---|
| ***D06F 39/10*** | (2006.01) |
| ***D06F 25/00*** | (2006.01) |
| ***D06F 39/04*** | (2006.01) |
| ***D06F 58/20*** | (2006.01) |
| ***D06F 58/22*** | (2006.01) |
| *D06F 105/34* | (2020.01) |

(52) U.S. Cl.

CPC ..... *D06F 39/10* (2013.01); *D06F 25/00* (2013.01); *D06F 39/04* (2013.01); *D06F 58/206* (2013.01); *D06F 58/22* (2013.01); *D06F 2105/34* (2020.02)

(58) Field of Classification Search

CPC ..... D06F 25/00; D06F 58/22; D06F 58/206; D06F 2105/34; D09F 39/04; D09F 39/10

See application file for complete search history.

(56) References Cited

U.S. PATENT DOCUMENTS

| | | | | |
|---|---|---|---|---|
| 9,695,540 | B2 | 7/2017 | Leibman et al. | |
| 10,661,214 | B2 | 5/2020 | Kim et al. | |
| 2010/0223960 | A1* | 9/2010 | Kim | D06F 25/00 68/20 |

(Continued)

FOREIGN PATENT DOCUMENTS

| | | | | |
|---|---|---|---|---|
| CN | 117966446 | A * | 5/2024 | D06F 43/085 |
| DE | 10249110 | B4 | 3/2006 | |

(Continued)

OTHER PUBLICATIONS

Machine translation of CN 117966446 A to Lian et al. (Year: 2024).*

(Continued)

*Primary Examiner* — Joseph L. Perrin

(74) *Attorney, Agent, or Firm* — Dority & Manning, P.A.

(57) ABSTRACT

An air filter assembly for a laundry treatment appliance includes a filter compartment defining a filter receiving space, the filter compartment including an inner peripheral face and an insertion opening; a plurality of compartment ribs extending from the inner peripheral face of the filter compartment toward the filter receiving space; an air filter selectively received within the filter receiving space via the insertion opening, the air filter including an outer peripheral face and a handle; and a plurality of cartridge ribs extending from the outer peripheral face of the air filter. The plurality of cartridge ribs mesh with the plurality of compartment ribs when the air filter is in an inserted position within the filter receiving space.

20 Claims, 9 Drawing Sheets

(56) References Cited

U.S. PATENT DOCUMENTS

| | | | | |
|---|---|---|---|---|
| 2015/0197882 | A1* | 7/2015 | Ahn | F25B 27/02 62/238.7 |
| 2020/0316501 | A1 | 10/2020 | Jones | |
| 2023/0220606 | A1* | 7/2023 | Liu | D06F 25/00 68/12.15 |
| 2024/0229335 | A1* | 7/2024 | Dunn | D06F 39/12 |
| 2024/0229337 | A1* | 7/2024 | Boado Encinosa | D06F 58/22 |

FOREIGN PATENT DOCUMENTS

| | | | | |
|---|---|---|---|---|
| EP | 3536847 | B1 | 6/2021 | |
| WO | WO-2022022170 | A1 * | 2/2022 | D06F 25/00 |

OTHER PUBLICATIONS

Machine translation of EP 3536847 A1 to Rã¶sch et al. (Year: 2019).*
Machine translation of WO 2022/022170 A1 to Liu et al. (Year: 2022).*

* cited by examiner

LAUNDRY APPLIANCE AIR FILTER WITH LABYRINTH SEAL

FIELD OF THE INVENTION

The present subject matter relates generally to laundry appliances, and more particularly to air filters for laundry appliances.

BACKGROUND OF THE INVENTION

Laundry appliances include washing machine appliances, dryer appliances, and combination laundry appliances. Combination laundry appliances, sometimes also referred to as washer/dryer appliances, provide both washing and drying functions in a single unit. During the washing and drying operations, particles from clothing articles being treated therein, such as fiber particles, are dislodged and may become entrained in the flow of air through the laundry appliance. Such particles, e.g., lint, may impair the performance of the laundry appliance's heating system if the particles are carried to, for example, a heater of the heating system, by the flow of air. Thus, laundry appliances typically include at least one air filter, sometimes also referred to as a lint filter, to entrap such particles and remove the particles from the air flow. Over time, when the entrapped particles accumulate on the air filter, the air filter may be removed from the laundry appliance in order to clean the air filter, e.g., to remove the accumulated particles.

When the air filter is installed in the laundry appliance, it is desirable to form a seal with adjacent components, e.g., to avoid or restrict bypass air flow around the air filter. However, removing and reinstalling the air filter, e.g., for cleaning, may result in excess wear on sealing elements of the air filter. Moreover, existing sealing elements and method present certain drawbacks. For instance, existing sealing elements can result in a requirement of a large pull force to remove the air filter from a filter box or compartment.

Accordingly, a laundry treatment appliance with an air filter assembly which obviates one or more of the above-mentioned drawbacks would be beneficial. In particular, an air filter with an improved sealing system would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a laundry treatment appliance is provided. The laundry treatment appliance may include a cabinet; a tub positioned within the cabinet, the tub defining a tub outlet and a tub inlet; a heating system in thermal communication with the tub, wherein heated air flows from the heating system to the tub; and an air filter assembly positioned between the tub and the heating system upstream from the heating system. The air filter assembly may include a filter compartment defining a filter receiving space, the filter compartment including an inner peripheral face and an insertion opening; a plurality of compartment ribs extending from the inner peripheral face of the filter compartment toward the filter receiving space; an air filter selectively received within the filter receiving space via the insertion opening, the air filter including an outer peripheral face and a handle; and a plurality of cartridge ribs extending from the outer peripheral face of the air filter, wherein the plurality of cartridge ribs mesh with the plurality of compartment ribs when the air filter is in an inserted position within the filter receiving space.

In another exemplary aspect of the present disclosure, an air filter assembly for an appliance is provided. The air filter assembly may include a filter compartment defining a filter receiving space, the filter compartment including an inner peripheral face and an insertion opening; a plurality of compartment ribs extending from the inner peripheral face of the filter compartment toward the filter receiving space; an air filter selectively received within the filter receiving space via the insertion opening, the air filter including an outer peripheral face and a handle; and a plurality of cartridge ribs extending from the outer peripheral face of the air filter, wherein the plurality of cartridge ribs mesh with the plurality of compartment ribs when the air filter is in an inserted position within the filter receiving space.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
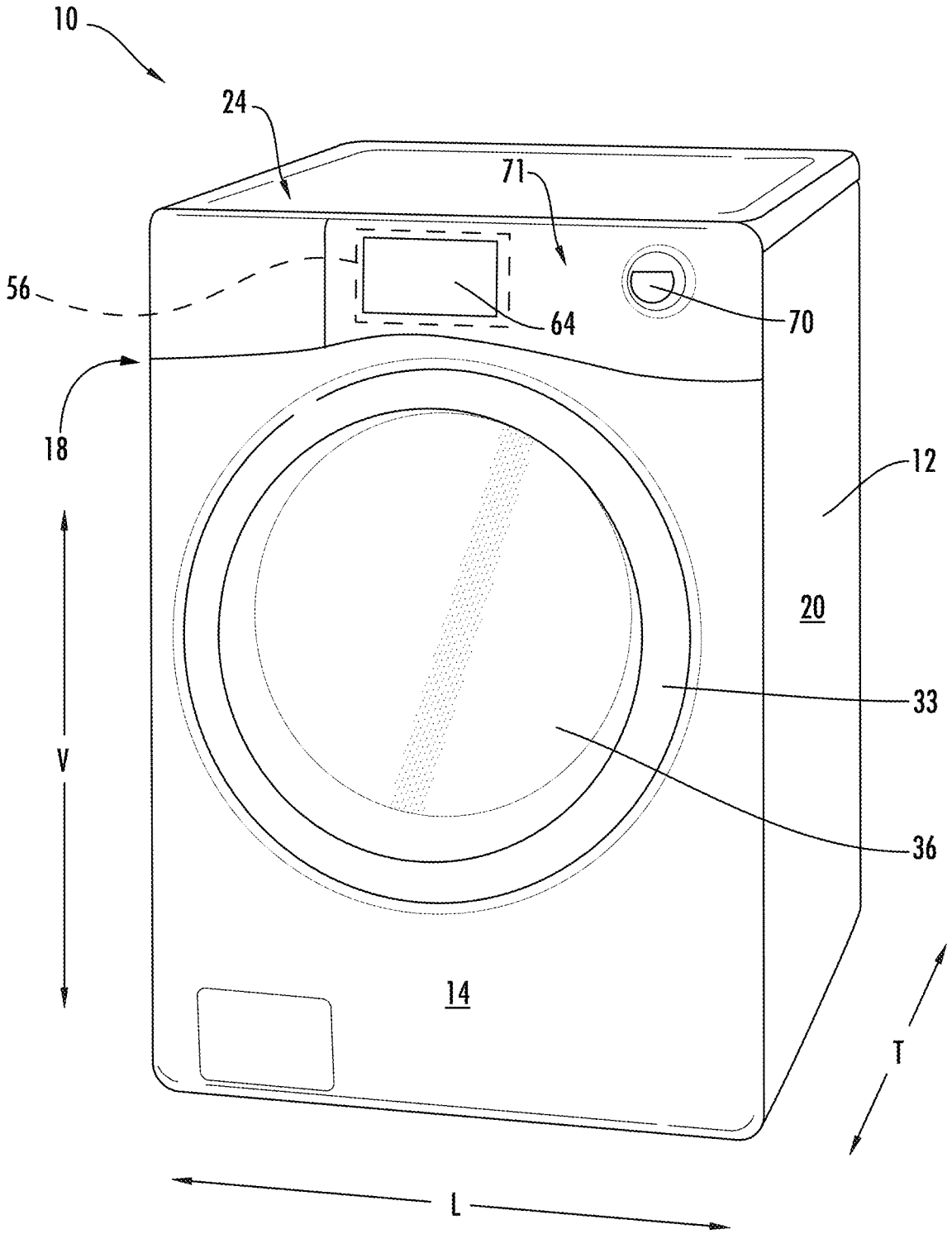
FIG. 1 provides a perspective view of a laundry appliance in accordance with one or more exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
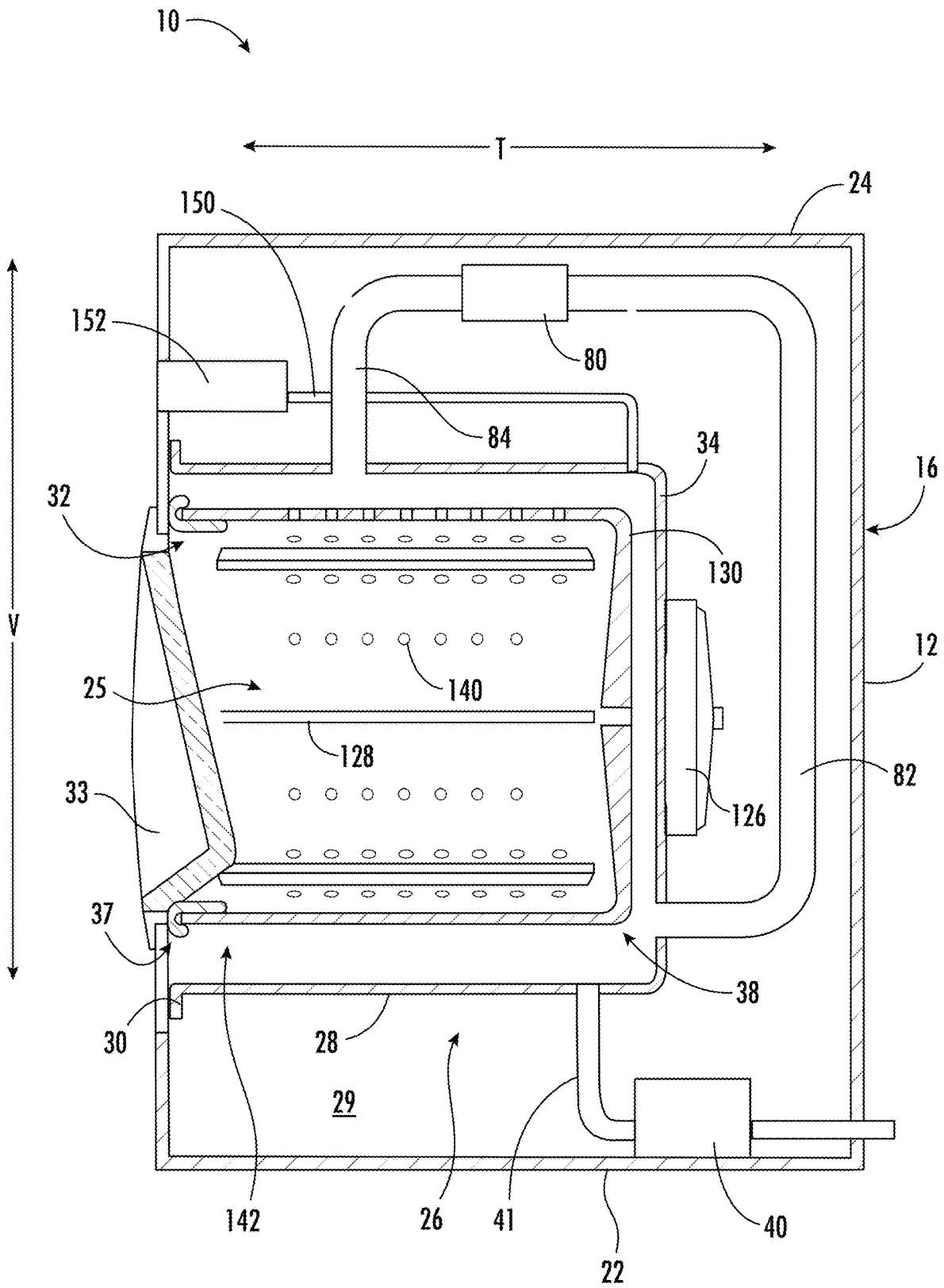
FIG. 2 provides a schematic cross-section view of the example laundry appliance of FIG. 1.
Figure 3:
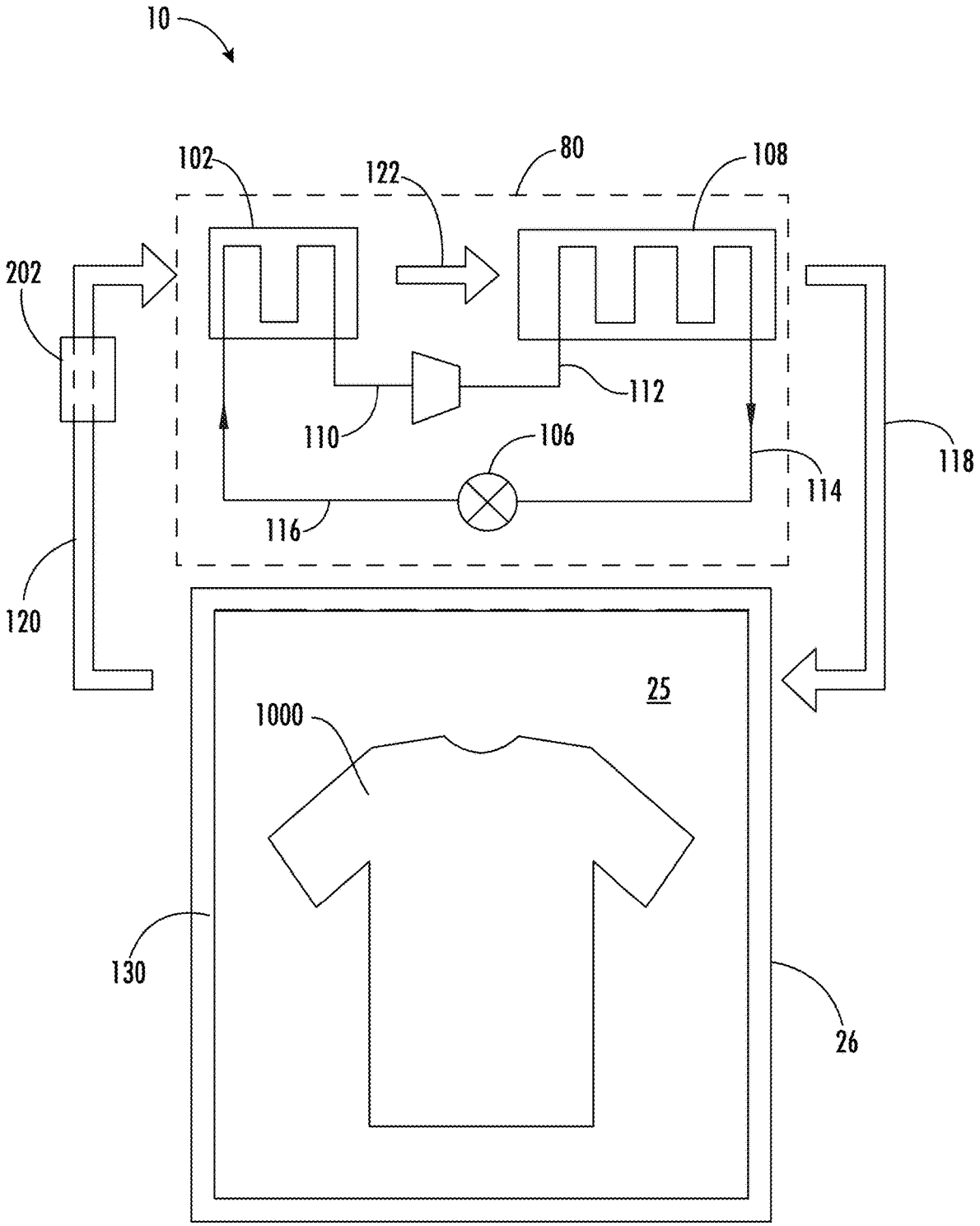
FIG. 3 provides a schematic diagram of an exemplary heat exchange heating system of the example laundry appliance of FIG. 1 according to one or more embodiments of the present disclosure.
Figure 4:
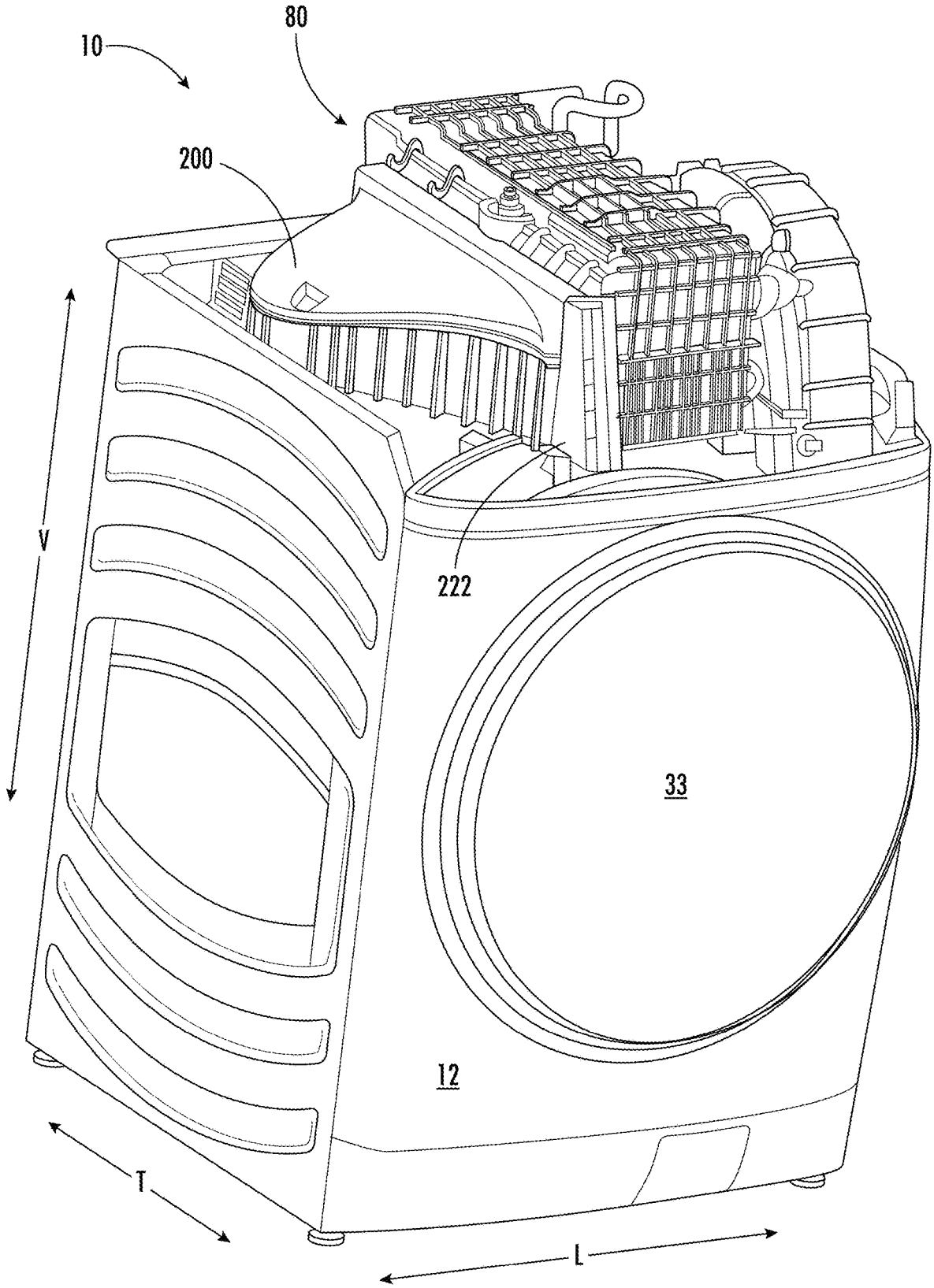
FIG. 4 provides a perspective view of the laundry appliance of FIG. 1 with a portion of a cabinet thereof removed to show internal components of the laundry appliance in accordance with one or more exemplary embodiments of the present disclosure.
Figure 5:
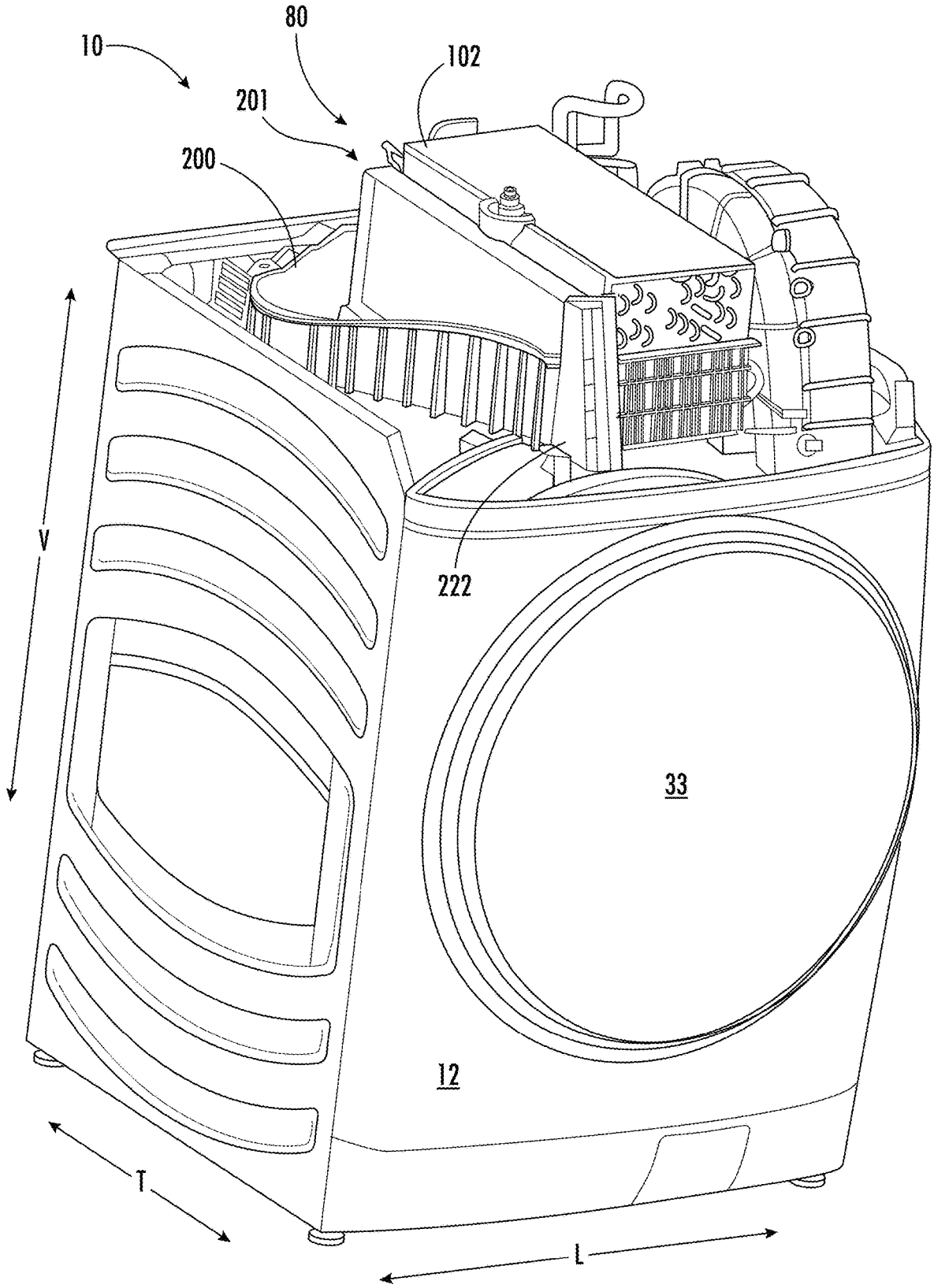
FIG. 5 provides another perspective view of the laundry appliance of FIG. 1 with portions of a housing removed to show an air filter assembly and a heating system therein in accordance with one or more exemplary embodiments of the present disclosure.

Embodiments of the present disclosure include a laundry appliance, e.g., a combination washer-dryer appliance, such as the exemplary combination appliance 10 illustrated in FIGS. 1 through 5. FIG. 1 provides a perspective view of a laundry appliance 10 according to exemplary embodiments of the present disclosure. Laundry appliance 10 may be a combination laundry appliance, and may also be referred to as a multifunction laundry appliance or washer/dryer combination appliance. FIG. 2 provides a section view of laundry appliance 10. FIG. 3 provides a schematic illustration of a heat pump heating system which may be incorporated into laundry appliance 10. FIGS. 4 and 5 provide additional perspective views of laundry appliance 10. Laundry appliance 10 generally defines a vertical direction V, a lateral direction L, and a transverse direction T, each of which is mutually perpendicular, such that an orthogonal coordinate system is defined. While described in the context of a specific embodiment of laundry appliance 10, using the teachings disclosed herein, it will be understood that laundry appliance 10 is provided by way of example only. Other laundry appliances having different appearances and different features may also be utilized with the present subject matter as well.

Laundry appliance 10 may include a cabinet 12. Cabinet 12 may include a front panel 14, a rear panel 16, a left side panel 18 and a right side panel 20 spaced apart from each other by front and rear panels 14 and 16, a bottom panel 22, and a top cover 24. As used herein, terms such as "left" and "right" or "front" and "back" refer to directions from the perspective of a user facing laundry appliance 10 for accessing and/or operating laundry appliance 10. For example, a user stands in front of laundry appliance 10, e.g., at or near front panel 14, to access a door 33 and/or inputs 70 (described in more detail below). Within cabinet 12, an interior volume 29 is defined. A drum or tub 26 may be mounted within interior volume 29. A laundry basket 130 may be mounted within tub 26. Laundry basket 130 may define a chamber 25 for receipt of articles of clothing for treatment, e.g., washing, rinsing, spinning, tumbling, and/or drying.

In some embodiments, one or more selector inputs 70, such as knobs, buttons, touchscreen interfaces, etc., may be provided or mounted on cabinet 12, e.g., on a control panel 71 thereof and may be in operable communication (e.g., electrically coupled or coupled through a wireless network band) with a processing device or controller 56. Control panel 71 may also include a display 64. Controller 56 may also be provided in operable communication with various components of laundry appliance 10, such as a motor, a blower, and/or a heating system 80 (described below). In turn, signals generated in controller 56 may direct operation of such components in response to the position of inputs 70. As used herein, "processing device" or "controller" may refer to one or more microprocessors, microcontroller, ASICS, or semiconductor devices and is not restricted necessarily to a single element. Controller 56 may be programmed to operate laundry appliance 10 by executing instructions stored in memory (e.g., non-transitory media). Controller 56 may include, or be associated with, one or more memory elements such as RAM, ROM, or electrically erasable, programmable read only memory (EEPROM). For example, the instructions may be software or any set of instructions that when executed by the processing device, cause the processing device to perform operations. It should be noted that controllers as disclosed herein are capable of and may be operable to perform any methods and associated method steps as disclosed herein. For example, in some embodiments, methods disclosed herein may be embodied in programming instructions stored in the memory and executed by controller 56.

Tub 26 may extend between a front portion 37 and a back portion 38. Tub 26 may be generally cylindrical in shape, having an outer cylindrical wall 28 and a front flange or wall 30 that defines an opening 32 of tub 26, e.g., at front portion 37 of tub 26, for loading and unloading of articles into and out of a chamber 25 defined by and within a laundry basket 130 inside of tub 26. Tub 26 may include a rear wall 34 opposite front flange 30. A door 33 may provide for closing or accessing tub 26 through opening 32. A window 36 (FIG. 1) may be provided in door 33 for viewing of chamber 25 and/or laundry articles therein, e.g., during operation of laundry appliance 10.

Laundry basket 130 may be rotatably mounted within tub 26 such that laundry basket 130 is rotatable about an axis of rotation. According to the illustrated embodiment, the axis of rotation is substantially parallel to the transverse direction T. In this regard, laundry appliance 10 is generally referred to as a "horizontal axis" or "front load" laundry appliance 10. However, it should be appreciated that aspects of the present subject matter may be used within the context of a vertical axis or top load laundry appliance as well.

Laundry appliance 10 may include a motor assembly 126 that is in mechanical communication with laundry basket 130 to selectively rotate laundry basket 130. Motor assembly 126 may include a pancake motor, as illustrated, or any other suitable type, size, or configuration of motor may be used to rotate laundry basket 130 according to various embodiments. For example, a motor, such as a brushless DC motor, may be mounted within cabinet 12 and the motor may be coupled to laundry basket 130 by a belt and pulley, whereby the motor rotates laundry basket 130 through the belt and pulley.

Laundry basket 130 may define one or more agitator features that extend into chamber 25 to assist in agitation and cleaning of articles disposed within laundry chamber 25 during operation of laundry appliance 10. For example, as illustrated in FIG. 2, a plurality of ribs 128 may extend from laundry basket 130 into chamber 25. In this manner, for example, ribs 128 may lift articles disposed in laundry basket 130 during rotation of laundry basket 130, such as during an agitation or rinse portion of a wash operation of laundry appliance 10. During a drying operation of laundry appliance 10, ribs 128 may also lift articles in chamber 25 of laundry basket 130 and then allow such articles to tumble back to a bottom of laundry basket 130 as laundry basket 130 rotates.

As illustrated for example in FIG. 2, laundry basket 130 may also include a plurality of perforations 140 extending therethrough in order to facilitate fluid communication between chamber 25 and tub 26, e.g., whereby wash liquid may flow between tub 26 and chamber 25 during a wash operation or cycle. Additionally or alternatively, heated air may flow into chamber 25 and moisture-laden air may flow out of chamber 25 during a drying operation or cycle. A sump 142 may be defined by tub 26 outside of laundry basket 130 at a bottom of tub 26 along the vertical direction V. Thus, sump 142 may be configured for receipt of, and may generally collect, wash liquid (the wash liquid may include, e.g., water, and may also include additives such as detergents, etc.) during wash operations of laundry appliance 10. For example, during a wash operation of laundry appliance 10, wash liquid may be urged (e.g., by gravity) from chamber 25 within laundry basket 130 to sump 142 through the plurality of perforations 140. A pump assembly 40 may be located beneath tub 26 for gravity assisted flow when draining tub 26 (e.g., via a drain 41). Pump assembly 40 may also be configured for recirculating wash liquid within tub 26.

In some embodiments, laundry appliance 10 includes an additive dispenser or spout 150. For example, spout 150 may be in fluid communication with a water supply (not shown) in order to direct fluid (e.g., clean water) into tub 26. Spout 150 may also be in fluid communication with sump 142. For example, pump assembly 40 may direct wash liquid disposed in sump 142 to spout 150 in order to circulate wash liquid in tub 26.

As illustrated, a detergent dispenser drawer 152 may be slidably mounted within front panel 14. Detergent dispenser drawer 152 may receive an additive (e.g., detergent, fabric softener, bleach, or any other suitable liquid or powder) and direct the additive to chamber 25 during operation of laundry appliance 10. According to the illustrated embodiment, detergent dispenser drawer 152 may also be fluidly coupled to spout 150 to facilitate the complete and accurate dispensing of the additive.

In exemplary embodiments, during operation of laundry appliance 10, laundry items are loaded into laundry basket 130 through opening 32, and an operation is initiated through operator manipulation of input selectors 70. For example, a wash cycle may be initiated such that tub 26 is filled with water, detergent, or other fluid additives (e.g., via spout 150). One or more water valves (not shown) can be controlled by laundry appliance 10 to provide for filling laundry basket 130 to the appropriate level for the number of articles being washed or rinsed. By way of example, once laundry basket 130 is properly filled with fluid, the contents of laundry basket 130 may be agitated (e.g., with ribs 128) for an agitation phase of laundry items in laundry basket 130. During the agitation phase, basket 130 may be motivated about the axis of rotation at a set speed (e.g., a tumble speed) by a motor. As basket 130 is rotated, articles within basket 130 may be lifted by ribs 128 and permitted to drop therein due to gravity.

After the agitation phase of the washing operation is completed, tub 26 may be drained. Laundry articles may then be rinsed (e.g., through a rinse cycle) by again adding fluid to tub 26, depending on the particulars of the cleaning cycle selected by a user. Ribs 128 may again provide agitation within laundry basket 130. One or more spin cycles may also be used. In particular, a spin cycle may be applied after the wash cycle or after the rinse cycle in order to wring wash liquid from the articles being washed. During a spin cycle, basket 130 may be rotated at relatively high speeds. For instance, basket 130 may be rotated at one set speed (e.g., a pre-plaster speed) before being rotated at another set speed (e.g., a plaster speed). As would be understood by those of ordinary skill in the art, the pre-plaster speed may be greater than the tumble speed and the plaster speed may be greater than the pre-plaster speed. Moreover, agitation or tumbling of articles may be reduced as basket 130 increases its rotational velocity such that the plaster speed maintains the articles at a generally fixed position relative to basket 130.

After the spin cycle, a drying operation may begin. A supply duct 82 may be mounted to tub 26 and may extend between tub 26 and a heating assembly or system 80, whereby tub 26 is downstream of heating system 80 along the supply duct 82 such that heating system 80 supplies heated air that has been heated by heating system 80 to tub 26 via supply duct 82. A return duct 84 may also be mounted to tub 26 and may extend between tub 26 and heating system 80 whereby tub 26 is upstream of heating system 80 along return duct 84 such that heating system 80 receives relatively warm and humid air from tub 26 via return duct 84, e.g., air returns to heating system 80 from tub 26, e.g., after flowing over and around articles within chamber 25, through return duct 84. In some embodiments, e.g., as illustrated in FIGS. 2 and 3, heating system 80 may be positioned above tub 26 and return duct 84 may be oriented generally along the vertical direction V, and return duct 84 may also be referred to as a chimney. Supply duct 82 may be mounted to tub 26, e.g., at rear wall 34 thereof as in the illustrated example, or supply duct 82 may be mounted to cylindrical wall 28 of tub 26, such as above basket 130, similar to return duct 84 in the illustrated example embodiment.

Heating system 80, may include, e.g., a resistance heating element, a gas burner, and/or a heat pump, such as the example heat pump embodiment illustrated in FIG. 3 and described in more detail below, or any other suitable heat source. Moisture laden, warm air may be drawn from tub 26 by an air handler, such as a blower fan, which generates a negative air pressure within chamber 25. As the air passes from the blower fan, it may enter return duct 84 and then may be passed into heating system 80. Heated air (with a lower moisture content than was received from tub 26), may exit heating system 80 and may be supplied to tub 26 by supply duct 82. After the clothing articles have been dried, they may be removed from chamber 25 via opening 32.

Turning now to FIG. 3, a schematic view of selected components of one or more exemplary embodiments of laundry appliance 10 is provided. In particular, FIG. 3 illustrates components used during drying operations of laundry appliance 10. It is understood that, except as otherwise indicated, laundry appliance 10 in FIG. 3 may include some or all of the features described herein with respect to FIGS. 1, 2, 4, and 5.

In operation, one or more laundry articles 1000 may be placed within chamber 25 of laundry basket 130. Hot dry air 118 may be supplied to chamber 25 whereby moisture within laundry articles 1000 may be drawn from laundry articles 1000 by evaporation, such that warm saturated air 120 may flow from chamber 25 to an evaporator 102 of heating system 80, e.g., via return duct 84 illustrated in FIG. 2. As air passes across evaporator 102, the temperature of the air may be reduced through heat exchange with refrigerant that is vaporized within, for example, coils or tubing of evaporator 102. This vaporization process may absorb both the sensible and the latent heat from the moisture-laden air-thereby reducing its temperature. As a result, moisture in the air may be condensed and such condensate may be drained from heating assembly 80, as will be understood by those of ordinary skill in the art.

Air passing over evaporator 102 may become drier and cooler than when it was received from tub 26 of laundry appliance 10. As shown, cool dry air 122 from evaporator 102 may subsequently flow across a condenser 108 (e.g., across coils or tubing of condenser 108), which condenses refrigerant therein. The refrigerant may enter condenser 108 in a gaseous state at a relatively high temperature and pressure compared to the cool, dry air 122 from evaporator 102. As a result, heat energy may be transferred to the air at the condenser section 108, thereby elevating the temperature of the air and providing hot dry air 118 for supply to tub 26 of laundry appliance 10, e.g., via supply duct 82 illustrated in FIG. 2. The hot dry air 118 may pass over and around laundry articles 1000 within chamber 25 inside of tub 26, such that warm saturated air 120 is generated, as mentioned above. For example, the hot dry air may circulate around and through articles 1000 while articles 1000 are tumbled within chamber 25 such as by rotating basket 130, and the tumbling may be promoted by ribs 128 as well. Because the air is recycled through tub 26 and heating system 80, e.g., in a closed-loop as mentioned above, laundry appliance 10 may have a much greater efficiency than traditional clothes dryers where warm, moisture laden air is exhausted to the environment.

As shown in FIG. 3, some embodiments of heating system 80 include a compressor 104 that pressurizes refrigerant (i.e., increases the pressure of the refrigerant) supplied by a suction line 110 and generally motivates refrigerant through the sealed refrigerant circuit of heating system 80. Compressor 104 may be in operable communication with controller 56 and may generally be designed to pressurize a gas phase refrigerant. Accordingly, in order to avoid damage, refrigerant in suction line 110 may be supplied to compressor 104 in a gas phase from evaporator section 102. The pressurization of the refrigerant with compressor 104 may increase the temperature of the refrigerant (e.g., as directed by controller 56). The compressed refrigerant may be fed from compressor 104 to condenser 108 through line 112. As relatively cool air 122 from evaporator 102 is passed over condenser 108, the refrigerant may be cooled and its temperature lowered as heat is transferred to the air for supply to tub 26.

Upon exiting condenser 108, the refrigerant may be fed through line 114 to an expansion device 106. Although only one expansion device 106 is shown, such is by way of example only. It is understood that multiple such devices may be used. In the illustrated example, expansion device 106 is a thermal expansion valve. In additional embodiments, any other suitable expansion device, such as a capillary tube, may be used as well as or instead of thermal expansion valve 106. Expansion device 106 may lower the pressure of the refrigerant and control the amount of refrigerant that is allowed to enter evaporator 102 via line 116. Importantly, the flow of liquid refrigerant into evaporator 102 may be limited by expansion device 106 in order to keep the pressure low and allow expansion of the refrigerant back into the gas phase in evaporator 102. The evaporation of the refrigerant in evaporator 102 may convert the refrigerant from its liquid-dominated phase to a gas phase while cooling and drying the air 120 from tub 26. The process may be repeated as air is circulated through tub 26 and between evaporator 102 and condenser 108 while the refrigerant is cycled through the sealed refrigerant circuit, as described above.

Laundry appliance 10 may include an air filter 202, e.g., positioned between tub 26 and heating system 80 with air filter 202 being upstream of heating system 80, whereby air flowing from chamber 25 passes through and is filtered by air filter 202 before flowing to heating system 80.

As mentioned, air filter 202 may filter the air, e.g., air filter 202 may remove particles such as lint particles from the air, as well as dust, hair, or other airborne matter, as will be understood by those of ordinary skill in the art. Accordingly, such particles may accumulate on and in air filter 202, and in particular on an outer surface or upstream surface of air filter 202, over time. If left unchecked, such accumulated particles may eventually obstruct air flow through filter 202, resulting in reduced efficiency or performance of air filter 202 and/or laundry appliance 10, such as heating system 80 of laundry appliance 100. Thus, air filter 202 may be user accessible, e.g., to permit a user to clean air filter 202.

FIG. 4 provides a perspective view of laundry appliance 10 with a portion, e.g., an upper portion such as top cover 24, of cabinet 12 thereof removed to reveal internal components of laundry appliance 10. As illustrated in FIGS. 4 and 5, heating system 80 may be enclosed within a housing 200. As may be seen in FIG. 5, where an upper portion of housing 200 is also removed, e.g., in addition to the portion of cabinet 12, heating system 80 may include a heat exchanger, e.g., evaporator 102 (see, e.g., FIG. 3) and an air filter assembly 201 may be positioned between laundry basket 130 and heating system 80. Air filter 202 may be a part of air filter assembly 201. For example, air filter assembly 201 and air filter 202 therein may be positioned upstream of heating system 80, such as upstream of evaporator 102 of heating system 80, e.g., where evaporator 102 is the furthest upstream portion or component of heating system 80, e.g., the first component of heating system 80 to receive a flow of warm, moist air from chamber 25. With air filter assembly 201 so positioned, a flow of return air 120 (FIG. 3) from chamber 25 may pass through and may be filtered by air filter 202 before flowing to heating system 80. For example, air filter 202 may include a porous or air-permeable material, such as a foam material, which permits air to flow therethrough while trapping particles above a specified size therein. Additionally or alternatively, air filter 202 may include a screen filter material configured to trap particles above a second specified size therein (e.g., before flowing into the foam material). Air filter 202 and/or air filter assembly 201 may be removable from housing 200. For example, air filter assembly 201 may also include a handle 222, e.g., on an outer end of a shell 208 thereof, such as may be grasped by a user to extract air filter assembly 201 from housing 200.

Figure 6:
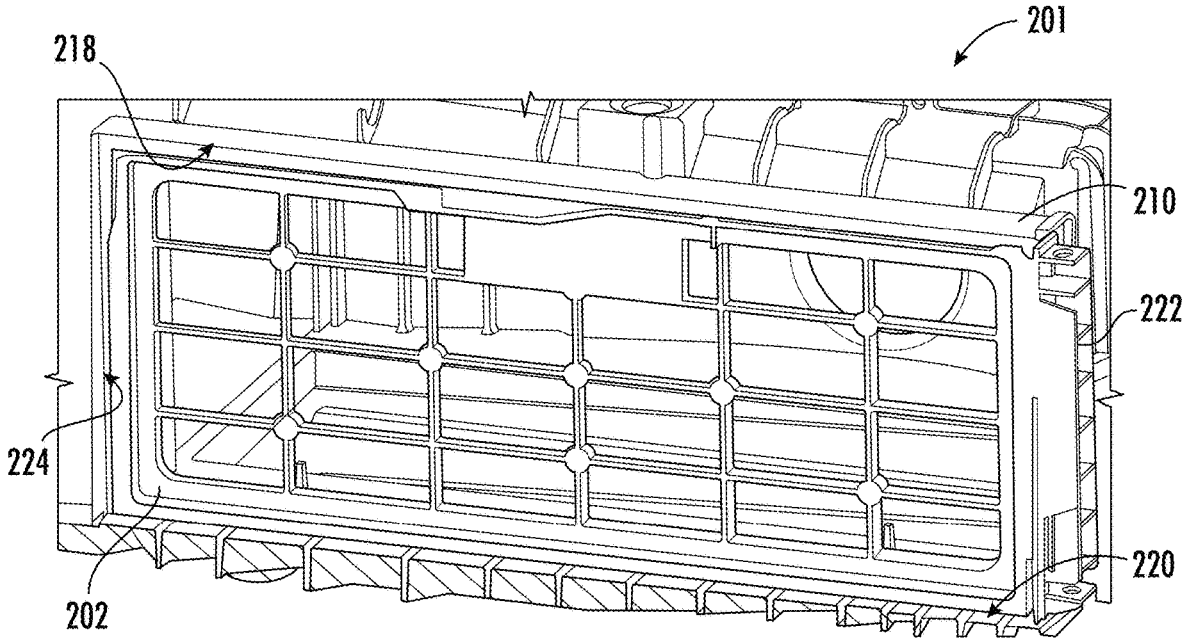
FIG. 6 provides a cutaway perspective view of the air filter assembly of FIG. 5 with a portion of a filter compartment removed to show the air filter.
Figure 7:
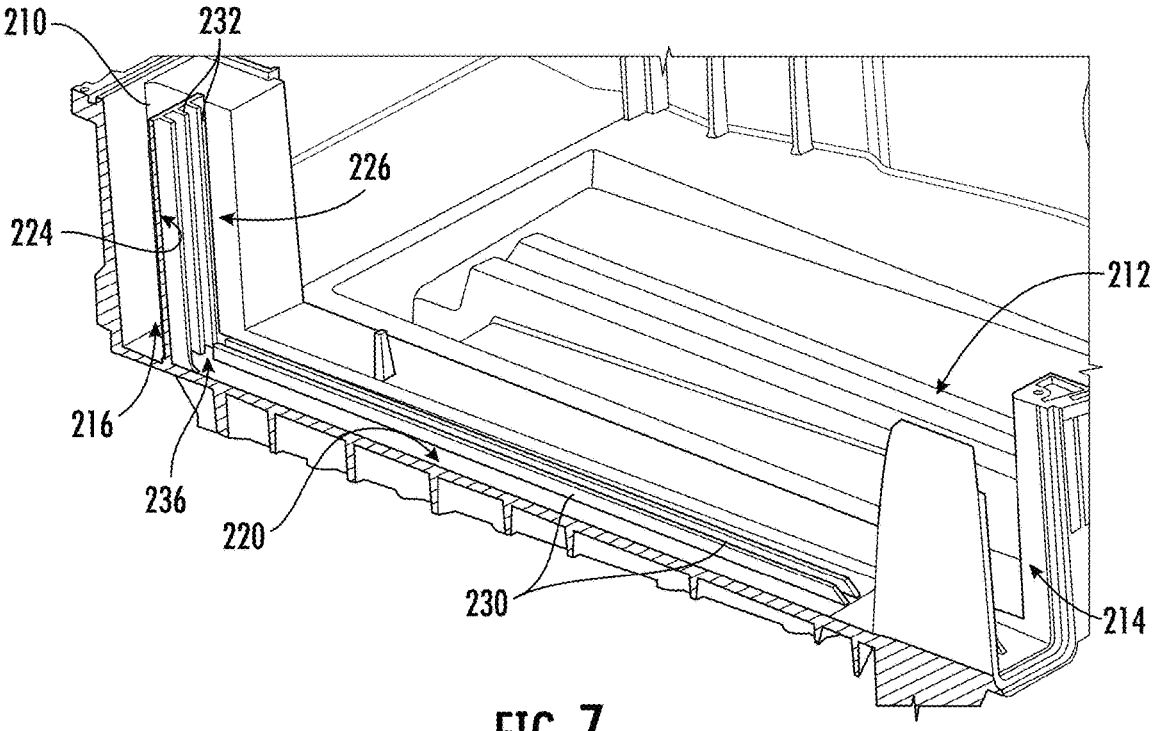
FIG. 7 provides a cutaway perspective view of the air filter assembly of FIG. 6 with the air filter removed.
Figure 8:
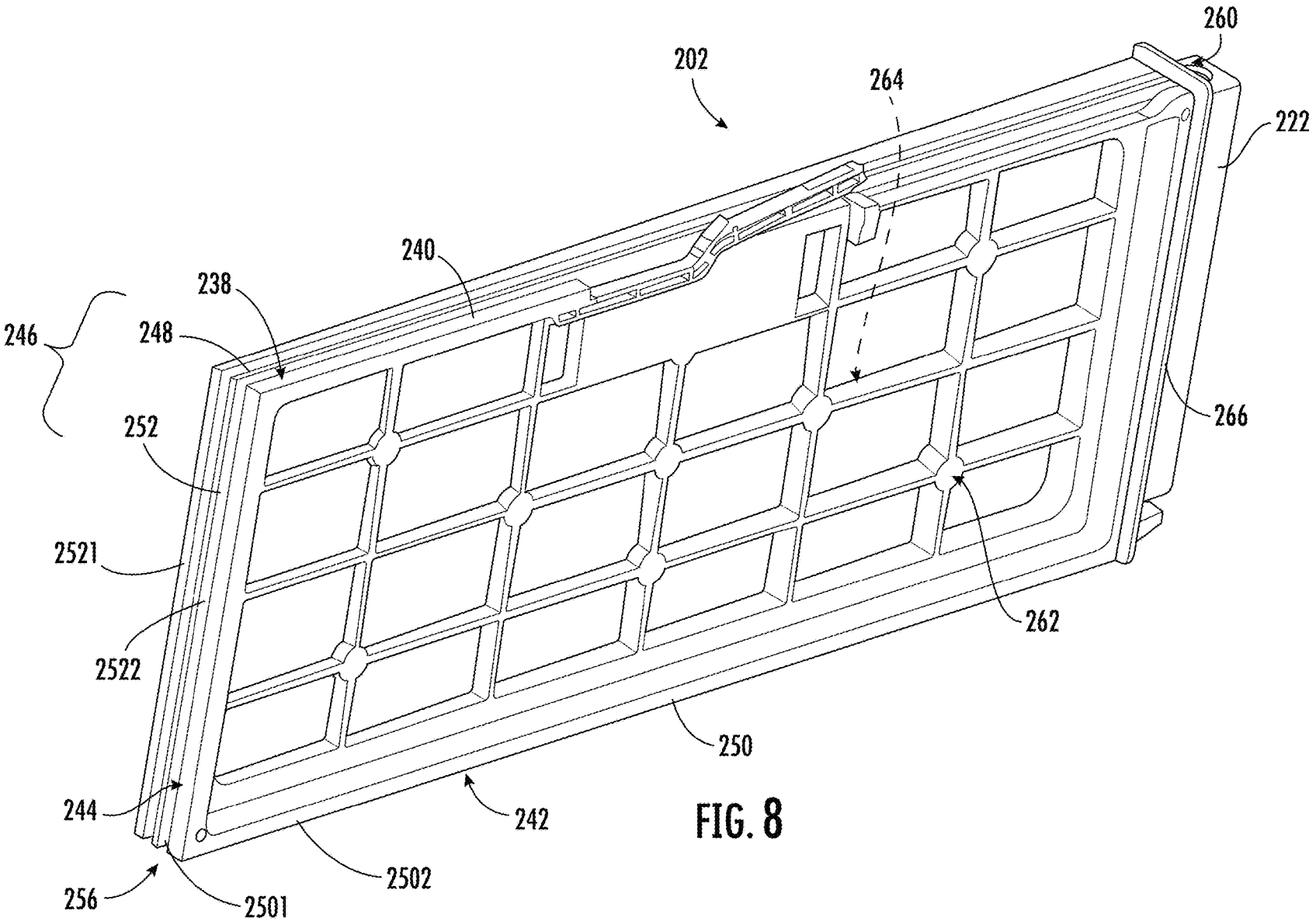
FIG. 8 provides a perspective view of the air filter of FIG. 6 removed from the filter compartment.
Figure 9:
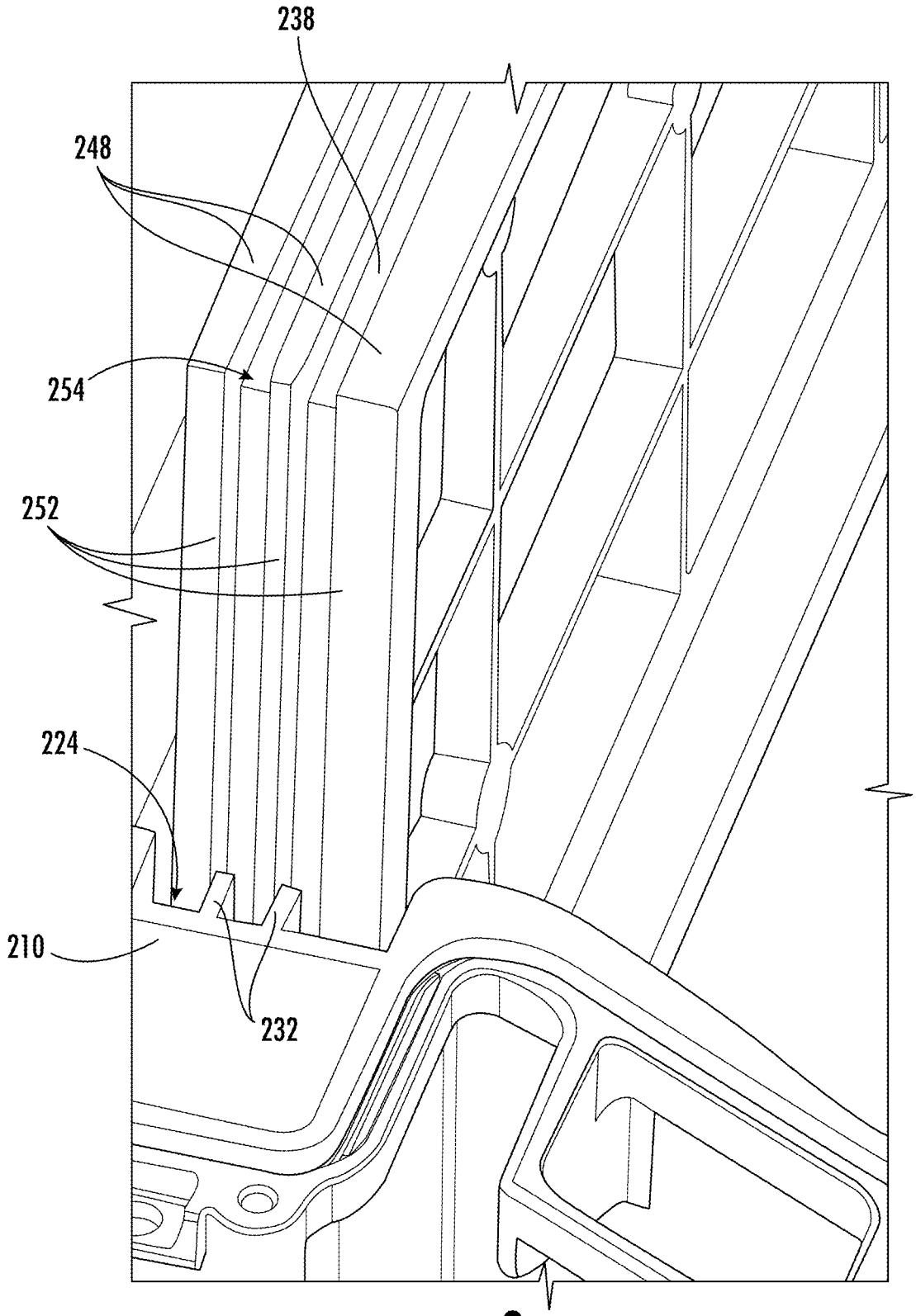
FIG. 9 provides a close-up cutaway side perspective view of the air filter assembly of FIG. 6.

Referring now to FIGS. 6 through 11, air filter assembly 201 may include a filter compartment 210. Filter compartment 210 may be positioned at or near housing 200 (e.g., at an air inlet to housing 200). For instance, filter compartment 210 may define a filter receiving space 212. Air filter 202 may be selectively received within filter receiving space 212. As seen in FIGS. 6 and 7, filter compartment 210 may include an insertion opening 214. Air filter 202 may be inserted into filter receiving space 212 via insertion opening 214. Accordingly, a shape of insertion opening 214 may be similar to a cross-sectional shape of air filter 202 (e.g., taken along the vertical direction V and the lateral direction L).

Filter compartment 210 may include an inner peripheral face 216. In detail, inner peripheral face 216 may define an upper boundary, a lower boundary, and a rear boundary of filter compartment 210 (e.g., in addition to insertion opening 214). Thus, inner peripheral face 216 may include a top face 218 (e.g., upper boundary), a bottom face 220 (e.g., lower boundary), and a rear face 224 (e.g., rear boundary). Bottom face 220 may be spaced apart from top face 218. Bottom face 220 may be predominantly parallel with top face 218. For instance, a distance between top face 218 and bottom face 220 may be approximately equal to a height of air filter 202 along the vertical direction V. Rear face 224 may connect top face 218 to bottom face 220 (e.g., at the rear boundary of filter receiving space 212). Thus, rear face 224 may be spaced apart from and predominantly parallel with insertion opening 214. Top face 218 may extend from insertion opening 214 to rear face 224 along the transverse direction T, bottom face 220 may extend from insertion opening 214 to rear face 224 along the transverse direction T, and rear face 224 may extend from top face 218 to bottom face 220 along the vertical direction V.

Figure 10:
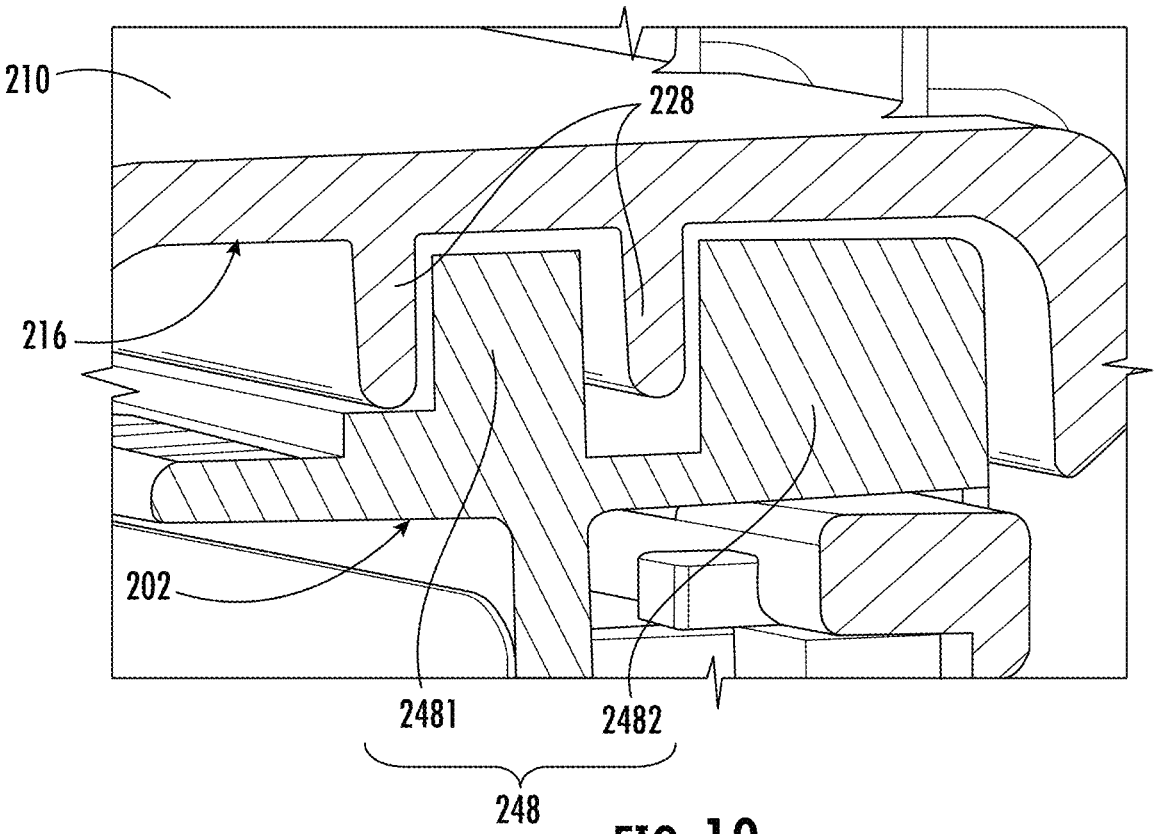
FIG. 10 provides a close-up perspective view of the air filter installed in the filter compartment of the air filter assembly of FIG. 6.
Figure 11:
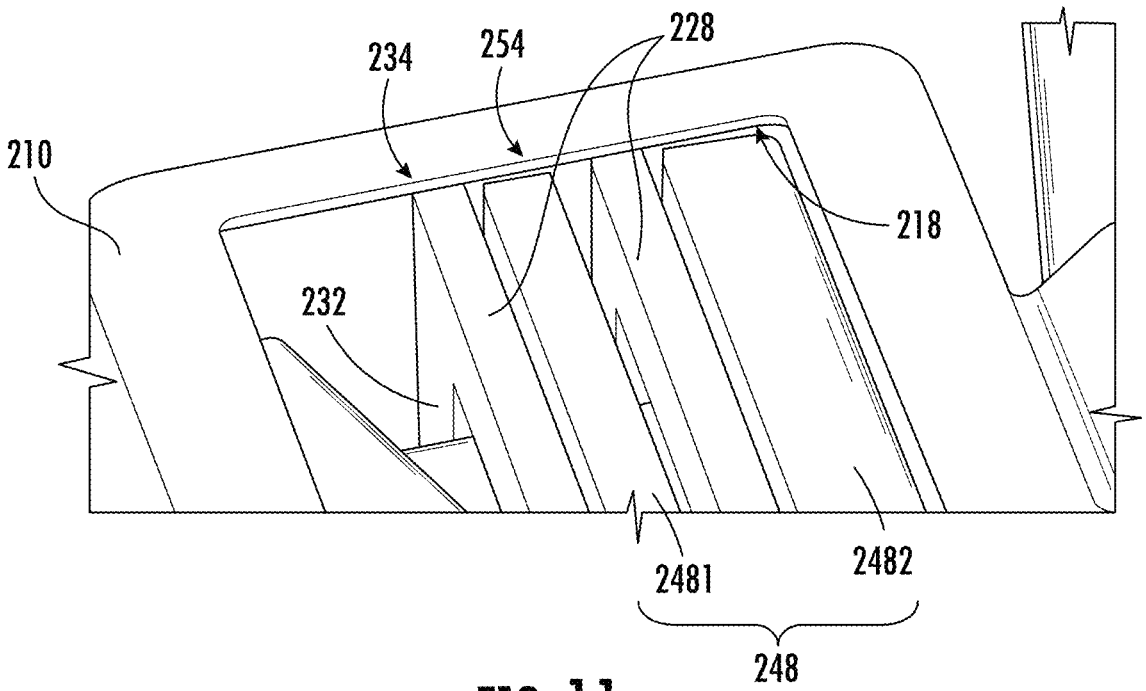
FIG. 11 provides a close-up perspective view of the air filter installed in the filter compartment of the air filter assembly of FIG. 6.

Filter compartment 210 may include a plurality of compartment ribs 226. The plurality of compartment ribs 226 may extend from inner peripheral face 216 toward filter receiving space 212. For instance, the plurality of compartment ribs 226 may include a plurality of top ribs 228 protruding from top face 218 downward along the vertical direction V. The plurality of top ribs 228 may include two top ribs, three top ribs, four top ribs, etc. Each of the plurality of top ribs 228 may extend along the transverse direction T. For instance, each of the plurality of top ribs 228 may extend from insertion opening 214 to rear face 224. As shown in FIG. 10, a close-up section of two top ribs 228 is shown interacting with air filter 202. Moreover, FIG. 11 shows two top ribs 228 with top face 218 removed. As seen, a protruding distance or length (e.g., along the vertical direction V) of each of the plurality of top ribs 228 may be relatively minimal compared with an extension length of each of the plurality of top ribs 228 (e.g., along the transverse direction T). For instance, when air filter 202 is in the inserted position, a distal edge of each of the plurality of top ribs 228 may be spaced apart from air filter 202 (e.g., an outer peripheral face thereof, described below) by a tolerance of between about ⅛ in. and about ¼ inch.

The plurality of compartment ribs 226 may include a plurality of bottom ribs 230 protruding from bottom face 220 upward along the vertical direction V. The plurality of bottom ribs 230 may include two bottom ribs, three bottom ribs, four bottom ribs, etc. Each of the plurality of bottom ribs 230 may extend along the transverse direction T. For instance, each of the plurality of bottom ribs 230 may extend from insertion opening 214 to rear face 224. Similar to the plurality of top ribs 228, a protruding distance or length (e.g., along the vertical direction V) of each of the plurality of bottom ribs 230 may be relatively minimal compared with an extension length of each of the plurality of bottom ribs 230 (e.g., along the transverse direction T). For instance, when air filter 202 is in the inserted position, a distal edge of each of the plurality of bottom ribs 230 may be spaced apart from air filter 202 (e.g., the outer peripheral face thereof) by a tolerance of between about ⅛ in. and about ¼ inch.

The plurality of compartment ribs 226 may include a plurality of rear ribs 232 protruding from rear face 224 inward (e.g., toward filter receiving space 212) along the lateral direction L. The plurality of rear ribs 232 may include two rear ribs, three rear ribs, four rear ribs, etc. Each of the plurality of rear ribs 232 may extend along the vertical direction V. For instance, each of the plurality of rear ribs 232 may extend from top face 218 to bottom face 220. Similar to the plurality of top ribs 228 and the plurality of bottom ribs 230, a protruding distance or length (e.g., along the vertical direction V) of each of the plurality of rear ribs 232 may be relatively minimal compared with an extension length of each of the plurality of rear ribs 232 (e.g., along the vertical direction T). For instance, when air filter 202 is in the inserted position, a distal edge of each of the plurality of rear ribs 232 may be spaced apart from air filter 202 (e.g., the outer peripheral face thereof) by a tolerance of between about ⅛ in. and about ¼ inch.

The plurality of top ribs 228 may connect with the plurality of rear ribs 232. In detail, at a junction between rear face 224 and top face 218, the plurality of top ribs 228 may meet with the plurality of rear ribs 232 at a first connection point 234 (see FIG. 11). Accordingly, a top rib 228 and a rear rib 232 may be formed as a seamless, single rib extending along the transverse direction T and the vertical direction V and protruding inward into filter receiving space 212. As would be understood, each of the plurality of top ribs 228 and rear ribs 232 may similarly be formed as seamless, single rib extending along the transverse direction T and the vertical direction V and protruding inward into filter receiving space 212.

The plurality of bottom ribs 230 may connect with the plurality of rear ribs 232. In detail, at a junction between rear face 224 and bottom face 220, the plurality of bottom ribs 230 may meet with the plurality of rear ribs 232 at a second connection point 236 (see FIG. 7). Accordingly, a bottom rib 230 and a rear rib 232 may be formed as a seamless, single rib extending along the transverse direction T and the vertical direction V and protruding inward into filter receiving space 212. As would be understood, each of the plurality of bottom ribs 230 and rear ribs 232 may similarly be formed as seamless, single rib extending along the transverse direction T and the vertical direction V and protruding inward into filter receiving space 212. Moreover, a top rib 228, a rear rib 232, and a bottom rib 230 may collectively be formed as a seamless, single rib extending around inner peripheral face 216 and protruding into filter receiving space 212.

As mentioned above, air filter assembly 201 may include air filter 202 selectively received within filter receiving space 212. Air filter 202 may include or define an outer peripheral face 238 along with handle 222. For instance, outer peripheral face 238 may include an upper face 240, a lower face 242, and an outer face 244. Lower face 242 may be spaced apart from upper face 240. Lower face 242 may be predominantly parallel to upper face 240. Outer face 244 may connect upper face 240 to lower face 242. Thus, outer face 244 may be spaced apart from and predominantly parallel with handle 222 (e.g., along the transverse direction T when air filter 202 is in the inserted position). Upper face 240 may extend from handle 222 to outer face 244 along the transverse direction T, lower face 242 may extend from handle 222 to outer face 244 along the transverse direction T, and outer face 244 may extend from upper face 240 to lower face 242 along the vertical direction V.

Air filter 202 may include a plurality of cartridge ribs 246. The plurality of cartridge ribs 246 may extend from outer peripheral face 238 toward inner peripheral face 216 (e.g., when air filter 202 is in the inserted position). For instance, the plurality of cartridge ribs 246 may include a plurality of upper ribs 248 protruding from upper face 240 upward along the vertical direction V. The plurality of upper ribs 248 may include two upper ribs, three upper ribs, four upper ribs, etc. Each of the plurality of upper ribs 248 may extend along the transverse direction T. For instance, each of the plurality of upper ribs 248 may extend from handle 222 to outer face 244. As shown in FIG. 10, a close-up section of two upper ribs 248 is shown interacting with top ribs 228 of filter receiving space 212. As seen, a protruding distance or length (e.g., along the vertical direction V) of each of the plurality of upper ribs 248 may be relatively minimal compared with an extension length of each of the plurality of upper ribs 248 (e.g., along the transverse direction T). For instance, when air filter 202 is in the inserted position, a distal edge of each of the plurality of upper ribs 248 may be spaced apart from inner peripheral face 216 of filter compartment 210 by a tolerance of between about ⅛ in. and about ¼ inch.

The plurality of cartridge ribs 246 may include a plurality of lower ribs 250 protruding from lower face 242 upward along the vertical direction V. The plurality of lower ribs 250 may include two lower ribs, three lower ribs, four lower ribs, etc. Each of the plurality of lower ribs 250 may extend along the transverse direction T. For instance, each of the plurality of lower ribs 250 may extend from handle 222 to outer face 244. Similar to the plurality of upper ribs 248, a protruding distance or length (e.g., along the vertical direction V) of each of the plurality of lower ribs 250 may be relatively minimal compared with an extension length of each of the plurality of lower ribs 250 (e.g., along the transverse direction T). For instance, when air filter 202 is in the inserted position, a distal edge of each of the plurality of lower ribs 250 may be spaced apart from inner peripheral face 216 of filter compartment 210 by a tolerance of between about ⅛ in. and about ¼ inch.

The plurality of cartridge ribs 246 may include a plurality of outer ribs 252 protruding from outer face 244 outward (e.g., toward rear face 224) along the lateral direction L. The plurality of outer ribs 252 may include two outer ribs, three outer ribs, four outer ribs, etc. Each of the plurality of outer ribs 252 may extend along the vertical direction V. For instance, each of the plurality of outer ribs 252 may extend from upper face 240 to lower face 242. Similar to the plurality of upper ribs 248 and the plurality of lower ribs 250, a protruding distance or length (e.g., along the vertical direction V) of each of the plurality of outer ribs 252 may be relatively minimal compared with an extension length of each of the plurality of outer ribs 252 (e.g., along the vertical direction T). For instance, when air filter 202 is in the inserted position, a distal edge of each of the plurality of outer ribs 252 may be spaced apart from rear face 224 by a tolerance of between about ⅛ in. and about ¼ inch.

The plurality of upper ribs 248 may connect with the plurality of outer ribs 252. In detail, at a junction between outer face 244 and upper face 240, the plurality of upper ribs 248 may meet with the plurality of outer ribs 252 at a first connection point 254 (see FIG. 9). Accordingly, an upper rib 248 and an outer rib 252 may be formed as a seamless, single rib extending along the transverse direction T and the vertical direction V and protruding outward toward inner peripheral face 216. As would be understood, each of the plurality of upper ribs 248 and outer ribs 252 may similarly be formed as seamless, single ribs extending along the transverse direction T and the vertical direction V and protruding outward toward inner peripheral face 216.

The plurality of lower ribs 250 may connect with the plurality of outer ribs 252. In detail, at a junction between outer face 244 and lower face 242, the plurality of lower ribs 250 may meet with the plurality of outer ribs 252 at a second connection point 256 (see FIG. 8). Accordingly, a lower rib 250 and an outer rib 252 may be formed as a seamless, single rib extending along the transverse direction T and the vertical direction V and protruding outward toward inner peripheral face 216. As would be understood, each of the plurality of lower ribs 250 and outer ribs 252 may similarly be formed as seamless, single rib extending along the transverse direction T and the vertical direction V and protruding outward toward inner peripheral face 216. Moreover, an upper rib 248, a rear rib 252, and a bottom rib 250 may collectively be formed as a seamless, single rib extending around outer peripheral face 238 and protruding outward toward inner peripheral face 216.

When air filter 202 is in the inserted position (e.g., inserted into filter receiving space 212), the plurality of cartridge ribs 246 may mesh with the plurality of compartment ribs 226. In detail, as mentioned above, the plurality of top ribs 228, the plurality of bottom ribs 230, and the plurality of rear ribs 232 may mesh with the plurality of upper ribs 248, the plurality of lower ribs 250, and the plurality of outer ribs 252, respectively, For instance, when air filter 202 is in the inserted position, a first top rib 228 may be positioned between a first upper rib 2481 and a second upper rib 2482 (FIG. 10) along the lateral direction L. Thus, as air filter 202 slides into the inserted position, first upper rib 2481 and second upper rib 2482 slide along first top rib 228. Similarly, as would be expected, a first bottom rib 230 may be positioned between a first lower rib 2501 and a second lower rib 2502 (FIG. 8) along the lateral direction L. Thus, as air filter 202 slides into the inserted position, first lower rib 2501 and second lower rib 2502 slide along first bottom rib 230. Additionally or alternatively, a first rear rib 232 may be positioned between a first outer rib 2521 and a second outer rib 2522 (FIG. 8) along the lateral direction L. Advantageously, when air filter 202 is in the inserted position, a labyrinth style seal may be formed between air filter 202 and filter compartment 210, thereby restricting flow of air outside of the air pathway through the filter material.

Air filter 202 may include a handle flange 260. Handle flange 260 may protrude from each of a front face 262, a rear face 264, upper face 240, and lower face 242. For instance, handle flange 260 may be configured to enclose filter receiving space 212 when air filter 202 is in the inserted position. Air filter 202 may include a handle gasket 266. Handle gasket 266 may be attached to handle flange 260. For instance, handle gasket 266 may face toward filter receiving space 212. Handle gasket 266 may mate with the plurality of upper ribs 248 and the plurality of lower ribs 250. Thus, each of the upper ribs 248 and each of the lower ribs 250 may have terminus points at handle gasket 266. Advantageously, the labyrinth style seal may be closed at handle gasket 266 when air filter is in the inserted position.

According to some embodiments, each of the plurality of bottom ribs 230 may be segmented. For example, a single bottom rib 230 may include a first segment or section, a second segment or section, a third segment or section, etc. The segments may be spaced apart along the extension direction of bottom rib 230 (e.g., along the transverse direction T. Accordingly, portions of one or more of bottom ribs 230 may be removed such that water or condensate may be permitted to flow therethrough (e.g., along bottom face 220).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry treatment appliance defining a vertical direction, a lateral direction, and a transverse direction, the laundry treatment appliance comprising:

a cabinet;

a tub positioned within the cabinet, the tub defining a tub outlet and a tub inlet;

a heating system in thermal communication with the tub, wherein heated air flows from the heating system to the tub; and an air filter assembly positioned between the tub and the heating system upstream from the heating system, the air filter assembly comprising:

a filter compartment defining a filter receiving space, the filter compartment comprising an inner peripheral face and an insertion opening;

a plurality of compartment ribs extending from the inner peripheral face of the filter compartment toward the filter receiving space;

an air filter selectively received within the filter receiving space via the insertion opening, the air filter comprising an outer peripheral face and a handle; and a plurality of cartridge ribs extending from the outer peripheral face of the air filter, wherein the plurality of cartridge ribs mesh with the plurality of compartment ribs when the air filter is in an inserted position within the filter receiving space.

2. The laundry treatment appliance of claim 1, wherein the inner peripheral face of the filter compartment comprises:

a top face;

a bottom face spaced apart from and parallel to the top face; and a rear face connecting the top face to the bottom face, the rear face being opposite the insertion opening.

3. The laundry treatment appliance of claim 2, wherein the plurality of compartment ribs comprises:

at least two top ribs protruding from the top face downward along the vertical direction and extending along the transverse direction from the insertion opening to the rear face;

at least two rear ribs protruding from the rear face inward along the transverse direction and extending along the vertical direction from the top face to the bottom face; and at least two bottom ribs protruding from the bottom face upward along the vertical direction and extending along the transverse direction from the insertion opening to the rear face.

4. The laundry treatment appliance of claim 3, wherein the at least two top ribs connect with the at least two rear ribs and a first connection point, and the at least two rear ribs connect with the at least two bottom ribs at a second connection point.

5. The laundry treatment appliance of claim 3, wherein the outer peripheral face of the air filter comprises:

an upper face;

a lower face spaced apart from and parallel to the upper face; and an outer face connecting the upper face to the lower face, the outer face being opposite the handle.

6. The laundry treatment appliance of claim 5, wherein the plurality of cartridge ribs comprises:

at least two upper ribs protruding from the upper face upward along the vertical direction and extending along the transverse direction from the handle to the outer face;

at least two outer ribs protruding from the outer face outward along the transverse direction and extending along the vertical direction from the upper face to the lower face; and at least two lower ribs protruding from the lower face downward along the vertical direction and extending along the transverse direction from the handle to the outer face.

7. The laundry treatment appliance of claim 6, wherein the at least two upper ribs connect with the at least two outer ribs and a first connection point, and the at least two outer ribs connect with the at least two lower ribs at a second connection point.

8. The laundry treatment appliance of claim 6, wherein the air filter further comprises:

a handle flange protruding from each of a front face, a rear face, the upper face, and the lower face of the air filter; and a handle gasket attached to the handle flange, the handle gasket facing toward the filter receiving space and mating with the at least two upper ribs and the at least two lower ribs.

9. The laundry treatment appliance of claim 6, wherein, when the air filter is in the inserted position:

a first top rib of the at least two top ribs is positioned between a first upper rib and a second upper rib of the at least two upper ribs along the lateral direction;

a first rear rib of the at least two rear ribs is positioned between a first outer rib and a second outer rib of the at least two outer ribs along the lateral direction; and a first bottom rib of the at least two bottom ribs is positioned between a first lower rib and a second lower rib of the at least two lower ribs along the lateral direction.

10. The laundry treatment appliance of claim 1, wherein the air filter comprises at least one of a screen filter material or a foam filter material.

11. An air filter assembly for an appliance comprising a heating system, the air filter assembly defining a vertical direction, a lateral direction, and a transverse direction, the air filter assembly comprising:

a filter compartment defining a filter receiving space, the filter compartment comprising an inner peripheral face and an insertion opening;

a plurality of compartment ribs extending from the inner peripheral face of the filter compartment toward the filter receiving space;

an air filter selectively received within the filter receiving space via the insertion opening, the air filter comprising an outer peripheral face and a handle; and a plurality of cartridge ribs extending from the outer peripheral face of the air filter, wherein the plurality of cartridge ribs mesh with the plurality of compartment ribs when the air filter is in an inserted position within the filter receiving space.

12. The air filter assembly of claim 11, wherein the inner peripheral face of the filter compartment comprises:

a top face;

a bottom face spaced apart from and parallel to the top face; and a rear face connecting the top face to the bottom face, the rear face being opposite the insertion opening.

13. The air filter assembly of claim 12, wherein the plurality of compartment ribs comprises:

at least two top ribs protruding from the top face downward along the vertical direction and extending along the transverse direction from the insertion opening to the rear face;

at least two rear ribs protruding from the rear face inward along the transverse direction and extending along the vertical direction from the top face to the bottom face; and at least two bottom ribs protruding from the bottom face upward along the vertical direction and extending along the transverse direction from the insertion opening to the rear face.

14. The air filter assembly of claim 13, wherein the at least two top ribs connect with the at least two rear ribs and a first connection point, and the at least two rear ribs connect with the at least two bottom ribs at a second connection point.

15. The air filter assembly of claim 13, wherein the outer peripheral face of the air filter comprises:

an upper face;

a lower face spaced apart from and parallel to the upper face; and an outer face connecting the upper face to the lower face, the outer face being opposite the handle.

16. The air filter assembly of claim 15, wherein the plurality of cartridge ribs comprises:

at least two upper ribs protruding from the upper face upward along the vertical direction and extending along the transverse direction from the handle to the outer face;

at least two outer ribs protruding from the outer face outward along the transverse direction and extending along the vertical direction from the upper face to the lower face; and at least two lower ribs protruding from the lower face downward along the vertical direction and extending along the transverse direction from the handle to the outer face.

17. The air filter assembly of claim 16, wherein the at least two upper ribs connect with the at least two outer ribs and a first connection point, and the at least two outer ribs connect with the at least two lower ribs at a second connection point.

18. The air filter assembly of claim 16, wherein the air filter further comprises:

a handle flange protruding from each of a front face, a rear face, the upper face, and the lower face of the air filter; and a handle gasket attached to the handle flange, the handle gasket facing toward the filter receiving space and mating with the at least two upper ribs and the at least two lower ribs.

19. The air filter assembly of claim 16, wherein, when the air filter is in the inserted position:

a first top rib of the at least two top ribs is positioned between a first upper rib and a second upper rib of the at least two upper ribs along the lateral direction;

a first rear rib of the at least two rear ribs is positioned between a first outer rib and a second outer rib of the at least two outer ribs along the lateral direction; and a first bottom rib of the at least two bottom ribs is positioned between a first lower rib and a second lower rib of the at least two lower ribs along the lateral direction.

20. The air filter assembly of claim 11, wherein the air filter comprises at least one of a screen filter material or a foam filter material.

* * * * *